US012402709B2

(12) United States Patent
Persons et al.

(10) Patent No.: US 12,402,709 B2
(45) Date of Patent: Sep. 2, 2025

(54) RECYCLABLE COSMETIC COMPACT

(71) Applicant: Derik Industrial USA, Inc., Thornwood, NY (US)

(72) Inventors: Richard F. Persons, Pleasantville, NY (US); Agostinho Martins, New Hyde Park, NY (US)

(73) Assignee: Derik Industrial USA, Inc., Thornwood, NY (US)

( * ) Notice: Subject to any disclaimer, the term of this patent is extended or adjusted under 35 U.S.C. 154(b) by 68 days.

(21) Appl. No.: 18/210,006

(22) Filed: Jun. 14, 2023

(65) Prior Publication Data

US 2023/0397707 A1 Dec. 14, 2023

Related U.S. Application Data

(60) Provisional application No. 63/352,163, filed on Jun. 14, 2022.

(51) Int. Cl.
*A45D 33/00* (2006.01)
*A45D 40/22* (2006.01)

(52) U.S. Cl.
CPC ..... *A45D 33/008* (2013.01); *A45D 40/22* (2013.01)

(58) Field of Classification Search
CPC ..... B65D 43/162; B65D 43/0206
USPC ..... 206/581, 823
See application file for complete search history.

(56) References Cited

U.S. PATENT DOCUMENTS 3,256,892 A * 6/1966 Esposito, Jr. ..... A45C 11/32 206/229
5,476,173 A 12/1995 Opresco
5,704,378 A 1/1998 Machelett
6,102,247 A * 8/2000 Crawford ..... B65D 83/0805 221/33
7,849,863 B2 12/2010 Francis et al.
8,356,952 B2 * 1/2013 Bennett ..... A45D 34/041 401/212
2004/0173498 A1 * 9/2004 Lee ..... A45D 42/04 206/581

(Continued)

FOREIGN PATENT DOCUMENTS

WO 2019237074 A1 12/2019

OTHER PUBLICATIONS

PCT Search Report and Written Opinion issued in PCT Application No. PCT/US2023/025328 dated Sep. 28, 2023.

*Primary Examiner* — Mollie Impink
(74) *Attorney, Agent, or Firm* — Weber Rosselli & Cannon LLP

(57) ABSTRACT

A tri-fold recyclable compact base including a pan receiving portion having an inner ring and an outer ring, the inner ring or the outer ring including at least one catch, and the inner ring configured to removably receive a cosmetics pan, a pan securing portion, the pan securing portion including a top flange and an inner ring extending perpendicularly from the top flange and an outer ring extending perpendicularly from the top flange, the inner ring or the outer ring including at least one circumferential ring configured to mate with the at least one catch, a first hinge rotatably connecting the pan receiving portion and the pan securing portion, a mirror receiving portion, and a second hinge rotatably connecting the mirror receiving portion and the pan securing portion.

19 Claims, 5 Drawing Sheets

(56) References Cited

U.S. PATENT DOCUMENTS

| | | | | |
|---|---|---|---|---|
| 2009/0236357 | A1* | 9/2009 | Giraud | B65D 43/162<br>220/849 |
| 2016/0309879 | A1* | 10/2016 | Zhang | A45D 33/003 |
| 2020/0275757 | A1 | 9/2020 | Korba | |
| 2021/0153621 | A1 | 5/2021 | Seidler | |
| 2021/0169198 | A1* | 6/2021 | Moretti | A45D 40/24 |
| 2022/0031046 | A1 | 2/2022 | Sobol et al. | |

* cited by examiner

RECYCLABLE COSMETIC COMPACT

FIELD

This disclosure relates to a make-up case or a cosmetic compact. More particularly, the disclosure relates to a cosmetic compact case that is refillable and can be broken down to maximize recyclable content.

BACKGROUND

Conventional compact cases hold makeup or cosmetics, such as, powders, eye shadow, eyeliner, lipstick, or other beauty aids. Compacts often provide a mirror for viewing the face, thereby facilitating the process of applying; the makeup to the face.

A compact usually includes a lid or a cover section hingeably coupled to a base or a container section. Either the cover section or the base section can be pivoted about the hinge to obtain the closed configuration of the compact, thereby providing a convenient storage device. The mirror is typically disposed on the inside of the compact cover section. The base section of conventional compacts usually includes a metal pan for containing the makeup. Alternatively, the makeup can be directly stored in a cavity in the base section.

The mirror and the pan are typically glue to the respective inner surfaces of the lid and base. Because of their being glued to the respective inner surfaces the entire compact must be placed in normal trash and cannot be recycled. In the absence of the glue however, the pan and mirror are very difficult to reliably secure in the compact. Accordingly, improvements are needed to meet the consumer demand of providing ever more recyclable content in consumer goods such as cosmetic compacts.

SUMMARY

One aspect of the disclosure is directed to a tri-fold recyclable compact base. The tri-fold recyclable compact base also includes a pan receiving portion including an inner ring and an outer ring, the inner ring or the outer ring including at least one catch, and the inner ring configured to removably receive a cosmetics pan; a pan securing portion, the pan securing portion including a top flange and an inner ring extending perpendicularly from the top flange and an outer ring extending perpendicularly from the top flange, the inner ring or the outer ring including at least one circumferential ring configured to mate with the at least one catch; a first hinge rotatably connecting the pan receiving portion and the pan securing portion; a mirror receiving portion; and a second hinge rotatably connecting the mirror receiving portion and the pan securing portion.

Implementations of this aspect of the disclosure may include one or more of the following features. The tri-fold recyclable compact base where rotation of the pan securing portion about the first hinge causes the at least one catch to receive the at least one circumferential ring and secure the pan securing portion to the pan receiving portion. The inner ring and outer ring of the pan receiving portion each include a catch. The inner ring and the outer ring each include a circumferential ring configured to mate with the catch of the inner ring and the outer ring of the pan receiving portion. Rotation of the pan securing portion about the first hinge causes the catches on each of the inner ring and the outer ring of the pan receiving portion to receive the circumferential ring on each of the inner ring and outer ring on the pan securing portion to secure the pan securing portion to the pan receiving portion. The tri-fold recyclable compact base further includes a pan of cosmetics in the pan receiving portion. The pan securing portion includes a lip extending from the top flange that overlaps the pan, the lip extending over the pan in the pan receiving portion. The tri-fold recyclable compact base further includes a cover secured in the mirror receiving portion. Tabs on the mirror receiving portion mate with a circumferential ring on the cover to secure the cover in the mirror receiving portion. The tri-fold recyclable compact base further includes a mirror inserted into the mirror receiving portion. The mirror is glued to the cover. The mirror is formed of a plastic and glued to the cover. The tri-fold recyclable compact base formed of polypropylene. The tri-fold recyclable compact base further includes an opening latch formed on the mirror receiving portion. The opening latch mates with the first hinge to hold the mirror receiving portion proximate the pan receiving portion. The mirror receiving portion includes a molded-in cover configured to have a mirror glued thereto.

These and other aspects of the disclosure are described herein with respect to the following drawings.

Those of ordinary skill in the art will recognize that FIGS. 3A-3I each depict alignment lines or cross-sectional indicator lines as are commonly used in drafting to ensure symmetry and alignment of the views or to inform the viewer of the origin of one or more views, these lines do not form a portion of this design or features of this disclosure.

DETAILED DESCRIPTION

Figure 1:
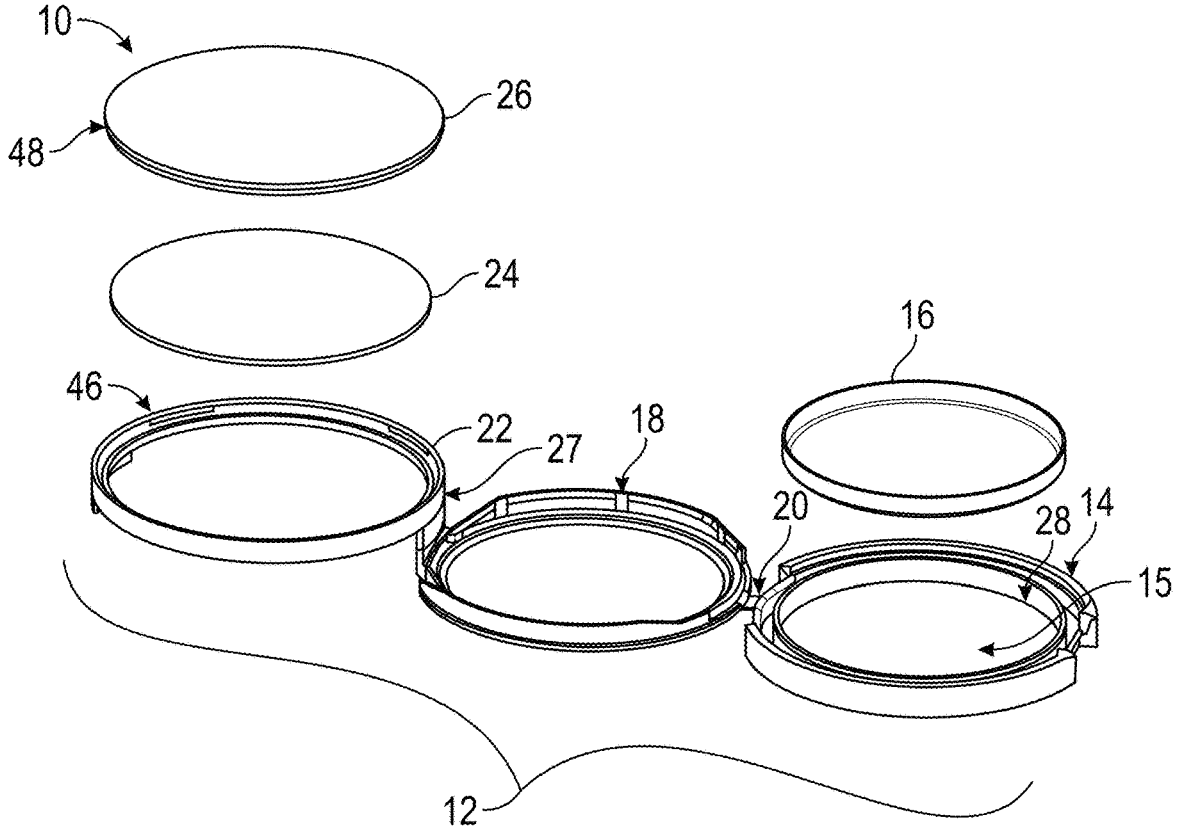
FIG. 1 is an exploded view diagram of a compact in accordance with the disclosure.

The instant disclosure is directed to a cosmetic compact and methods of forming a cosmetic compact to substantially increase the reusability and recyclability of the compact. FIG. 1 depicts an exploded view of a compact 10 in accordance with the disclosure. The compact 10 may be formed of for example, polypropylene, post-consumer polypropylene, or another plastic material that is highly recyclable yet also sufficiently durable to be reused multiple times without suffering damage. The compact 10 is formed of a tri-fold base 12. The tri-fold base 12 includes three portions including a pan receiving portion 14 having a solid bottom 15 and configured to receive a pan 16, for example an aluminum pan having a powdered make-up, and not allow the pan 16 to fall through the pan receiving portion 14. The tri-fold base 12 also includes a pan securing portion 18 that folds on a hinge 20 to mate with the pan receiving portion 14 and secure the pan 16 in the pan receiving portion 14 (See FIG. 2). The tri-fold base 12 includes a mirror receiving portion 22 configured to receive a mirror 24. A removable cover 26 secures the mirror 24 in the mirror receiving portion 22. The mirror receiving portion 22 is connected to the pan securing portion 18 by a hinge 27. In accordance with one aspect of the disclosure the hinges described herein are formed of the same material as the remainder of the tri-fold base 12 and as part of the molding process. In this manner metal pins, as is often used for cosmetic compacts, are eliminated.

In practice, the pan 16 is placed in the pan receiving portion 14, but is not glued, rather it is received in an inner ring 28 formed in the bottom of the pan receiving portion 14. The pan securing portion 18, is connected to the pan receiving portion 14 via the hinge 20 (e.g., a living hinge), and upon folding of the pan securing portion 18 into the pan receiving portion 14, the pan 16 is removably secured and prevented from falling out of the pan receiving portion 14.

Figure 2:
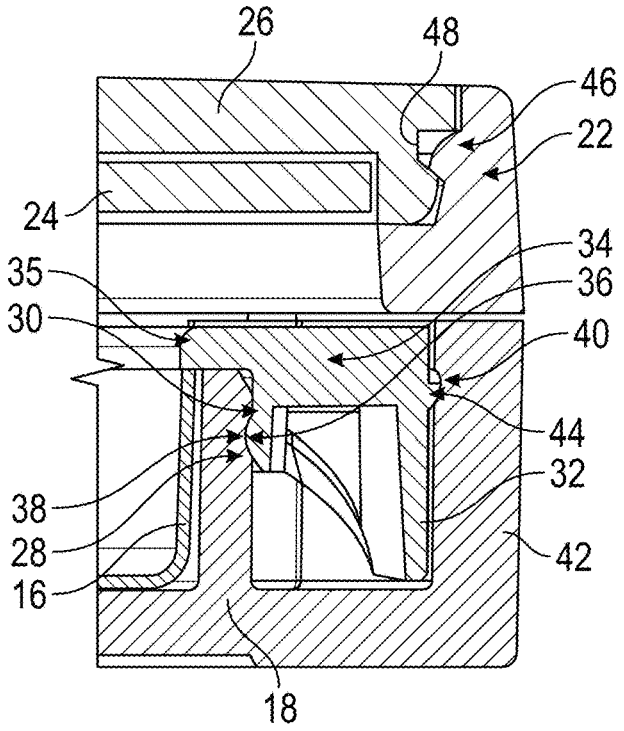
FIG. 2 is a cross sectional view of a portion of the compact depicted in FIG. 1 in a closed state and in accordance with the disclosure.

Details of the pan securing ring 18 and the manner of securing the pan 16 can be seen in FIG. 2, which is a cross-sectional view of a portion of the compact 10. The pan securing ring 18 includes an inner ring 30, and outer ring 32, and a top flange 34 spanning between the outer ring 32 and the inner ring 30 and a lip 35 extending over the pan 16. The inner ring 30 includes a circumferential lip 36 configured to mate with a catch 38 formed in the inner ring 28 of the pan receiving portion 14. A similar catch 40 is formed in an outer ring 42 of the pan receiving portion 14, the catch 40 receives a circumferential lip 44 formed on the outer ring 32 of the pan securing portion 18. Though described as a catch 38, 40 and circumferential lip 36, 44 these are just exemplary means of securing the two components together in a releasable snap-fit configuration and other means may be employed without departing from the scope of the disclosure.

The combination of the circumferential lip 36 and 44 with catches 38 and 40, respectively, secures the pan receiving portion 14 and the pan securing portion 18 to one another and traps the pan 16 therebetween. This is not a permanent securing of the pan 16 in the pan receiving portion 14 as gluing of the pan 16 would be. In accordance with the disclosure, securing forces applied by the circumferential lips 36, 44 and the catches 38, 40 can be overcome by for example pulling on the mirror receiving portion 22 to cause the pan securing portion 18 to separate from the pan receiving portion 14. The pan 16 may then be removed by the user and a new pan 16 (e.g., with fresh makeup) can be inserted. In this manner the volume of waste produced by the use of the compact 10 is reduced as the pan 16 may be replaced many times through the life of the compact 10.

In addition to the pan 16 being removable, application of pressure to the mirror 24 causes the mirror 24 and cover 26 releases from the mirror receiving portion 22. The mirror 24 may then be separated from the cover 26. The cover may be formed of the same material as the tri-fold base 12 and thus can be recycled together. The pan 16, which may be formed of, for example, aluminum is highly recyclable as well, albeit separately from the cover 26 and tri-fold base 12, which are formed of plastics, as noted above. The mirror 24 may be recycled, or if not, possible this forms the only no recyclable waste associated with the compact 10, greatly reducing the amount of waste as compared to current makeup container products. Further in some instances the mirror 24 may be glued to the cover 26, and while not ideal still greatly reduces the volume of waste and enables recycling of the tri-fold base 12 and pan 16.

As noted above hinge 27 (e.g., a living hinge) connects the mirror receiving portion 22 to the pan securing portion 18. The mirror receiving portion 22 includes tabs 46 configured to mate with a circumferential ring 48 formed on the cover 26. When forced together in mating engagement the tabs 46 and circumferential ring 48 secure the mirror and more particularly the cover on which it is mounted in the mirror receiving portion 22. The mirror 24 and cover 26 are secured in the mirror receiving portion 18 in normal use, but as noted above upon emptying of the cosmetics from the pan 16, a user may place pressure against the mirror 24 and disengage the circumferential ring 48 on the cover 26 from the tabs 46 in the mirror receiving portion 22, thus separating the mirror 24 and cover 26 from the tri-fold base 12.

Figure 3C:
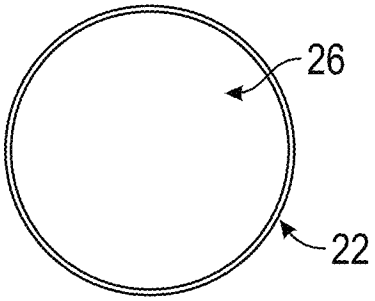
FIG. 3C is a top view of the compact of a compact in accordance with the disclosure.
Figure 3B:
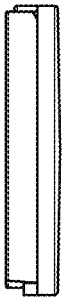
FIG. 3B is a left-side view or right-side view of a compact in accordance with the disclosure, the two sides are symmetrical and appear identical.
Figure 3A:
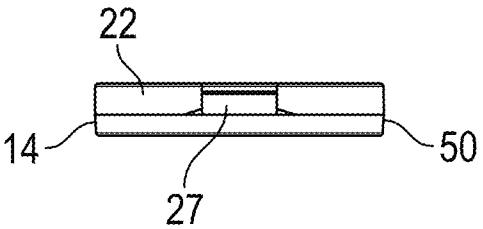
FIG. 3A is a rear view of a compact in accordance with the disclosure depicting a portion of a hinge allowing for rotational movement of portions of the compact.
Figure 3F:
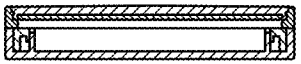
FIG. 3F is a cross sectional of a compact in accordance with the disclosure along line B-B of FIG. 3C.
Figure 3E:
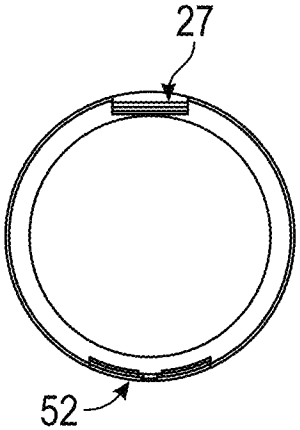
FIG. 3E is a bottom view of a compact in accordance with the disclosure.
Figure 3D:
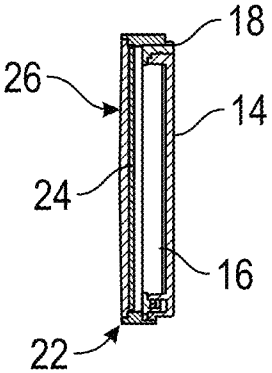
FIG. 3D is a cross-sectional view of a compact in accordance with the disclosure along line A-A of FIG. 3C, extending through a hinge and a latch of the compact.
Figure 3I:
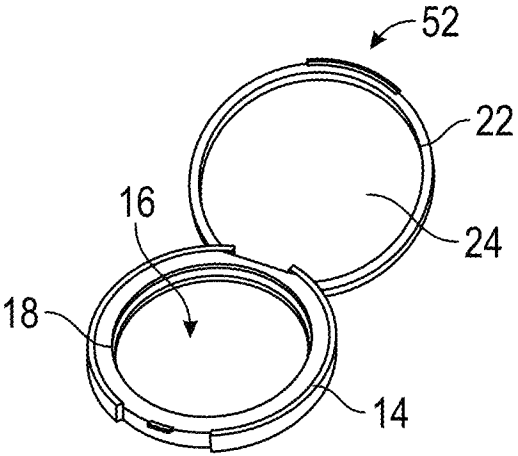
FIG. 3I is a perspective view of a compact in accordance with the disclosure in an open position.
Figure 3H:
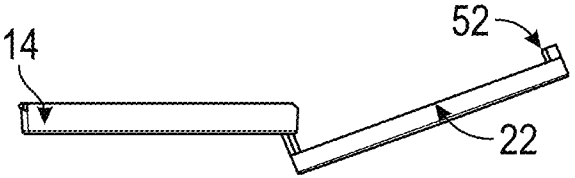
FIG. 3H is a left-side view or right-side view of a compact in accordance with the disclosure with the compact in a filled but open orientation, the two sides are symmetrical and appear identical.
Figure 3G:
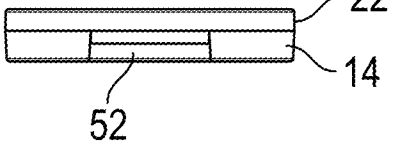
FIG. 3G is a front view of a compact in accordance with the disclosure depicting a latch mechanism to hold the compact in a closed position.

FIGS. 3A-3I depict the detailed design of the compact 10. FIG. 3A is a rear view of the compact 10 showing a portion of hinge 27. Line 50 notes the separation point of the mirror receiving portion 22 and the pan receiving portion 14, when the compact 10 is in the closed position. FIG. 3B is a side view of the compact 10. As the compact is round the left and right-side views of the compact appear the same. FIG. 3C is a top view of the compact 10 with the cover 26 secured in the mirror receiving portion 22. FIG. 3D is a cross sectional view of FIG. 3C along line A-A. FIG. 3E is a bottom view of the compact 10 with an opening latch 52 on one end and hinge 27 on the opposite side. As will be appreciated, application of pressure to the opening latch 52 opens the compact by rotating the mirror receiving portion 22 about the hinge 27. FIG. 3F is a cross-sectional view of the compact 10 along line B-B of FIG. 3C. The detail section of this cross-sectional view is depicted in FIG. 2. FIG. 3G is a front view of the compact 10 showing the opening latch 52 and the mirror receiving portion 22 and the pan receiving portion 14. FIG. 3H depicts a side view of the compact 10 in the open position and FIG. 3I depicts the compact 10 as a perspective view and in the open position.

Figure 4A:
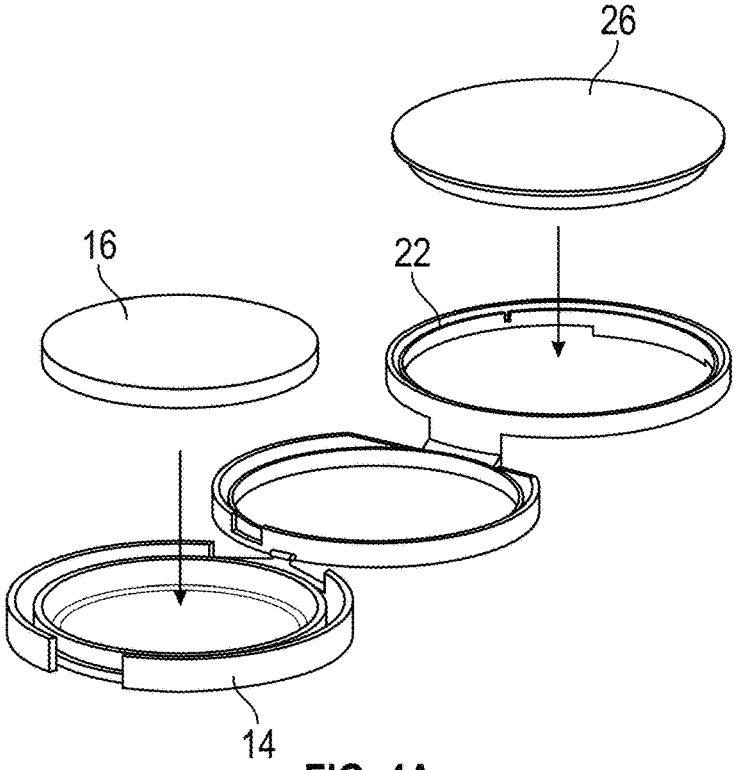
FIG. 4A is an exploded view of a tri-fold base receiving the mirror and cover and the pan.

As will be appreciated, cosmetic companies typically do not manufacture the products they sell and particularly not the containers (e.g., compact 10) in which their products are sold. The manufacturer may, in some instances, not only produce the compact 10 but may in some instances fill or partially fill the compact 10. In accordance with one aspect of the disclosure, following manufacture of the tri-fold base 12, the cover 26 and mirror 24 may be inserted into the mirror receiving portion 22 as shown in FIG. 4A. Optionally, the pan 16 with the cosmetic may be inserted into the pan receiving portion 14 by the manufacturer of the tri-fold base. In other instances, the cosmetics company or a third party contractor may insert the pan 16 into the pan receiving portion 14 at their facilities.

Figure 4B:
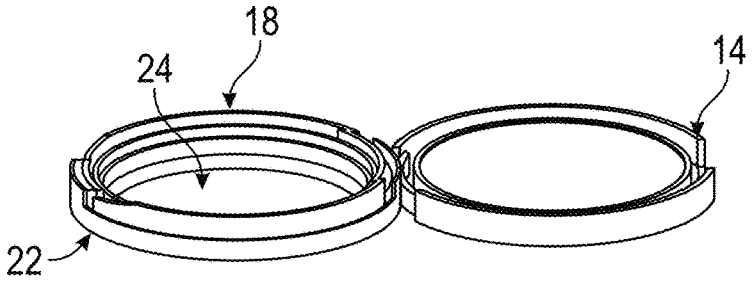
FIG. 4B is a perspective view of a compact as it might be shipped from a manufacturer to a cosmetic company, with the mirror receiving portion folded under the pan securing portion.

As shown in FIG. 4B the mirror receiving portion 22 may be folded under the pan securing portion 18. By folding the mirror receiving portion 22 under the pan securing portion 18 creates a low-profile subassembly that can be substantially flat packed to reduce the volume of the products being shipped (e.g., to a cosmetics company or third-party for filling with the cosmetic). The subassembly, with reduced profile may then be shipped to a customer such as a cosmetics company. However, those of ordinary skill in the art will understand that the disclosure is not so limited and the tri-fold base 12 may be shipped in any configuration, whether filled or not, from completely unfolded to completely folded without departing from the scope of the disclosure.

Figure 4C:
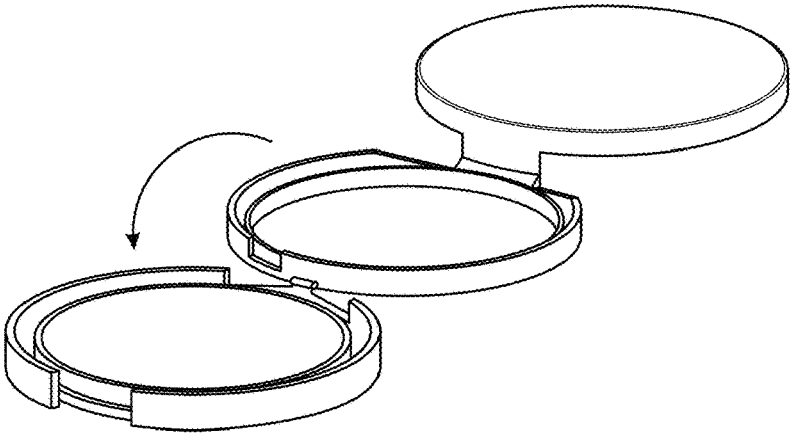
FIG. 4C is a perspective view of actions undertaken by a cosmetic company, with the unfolding of the mirror receiving portion from the pan securing portion.
Figure 4D:
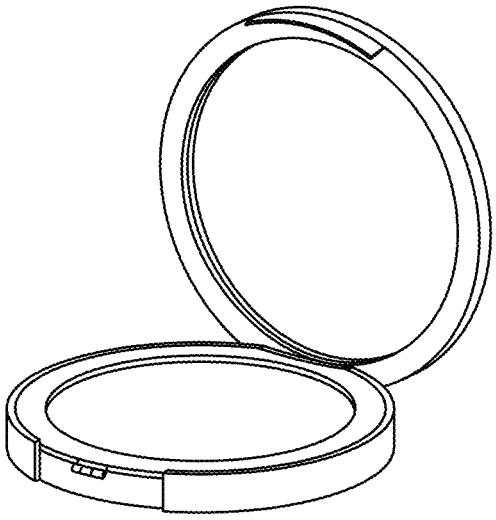
FIG. 4D is a perspective view of the compact with the pan securing portion secured into the pan receiving portion and the compact in an open position.
Figure 4E:
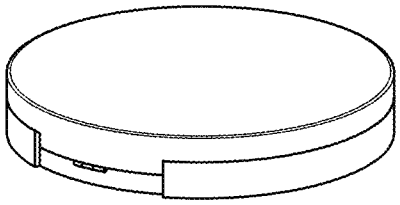
FIG. 4E is a perspective view of the compact in a closed position.

The cosmetics company, or third-party filler, will upon receipt of the compact 10 unfold the mirror receiving portion 22 from the pan securing portion 14 as shown in FIG. 4C. If necessary, they may then place a pan 16 with the cosmetics in the pan receiving portion 14 and fold via hinge 20 the pan securing portion 18 onto the pan receiving portion 14 to secure the pan 16 therebetween and result in an open compact 10 as depicted in FIG. 4D. Finally, if needed an applicator or puff (not shown) may be inserted into the compact 10 and the mirror receiving portion 22 and cover 26 folded on hinge 27 to close the compact 10 as shown in FIG. 4E. The completed and filled compact 10, whether filled by the cosmetics company or the third-party filler, is then packaged and distributed through the standard channels of commerce and ultimately purchase by a user.

The opening latch 52 formed on the perimeter of the mirror receiving portion 22 mates with the hinge 20 to releasably hold the compact 10 in the closed position as shown in FIG. 4E. At any time, the user wishes to access the cosmetic, deflecting the latch away from the hinge 20 allows for opening of the compact 10 by hinged motion of the mirror receiving portion 22 via hinge 27 relative to the combination of the pan receiving portion 14 and the pan securing portion 18, revealing both the cosmetic in the pan 16 and the mirror 24.

Upon completion of use, the user may easily disassemble the compact by first opening the compact 10 as described above. Once open, application of pressure to the mirror 24 and cover 26 forces the combination from the mirror receiving portion 22. The mirror 24 and cover 26 may not be recyclable owing to the mirror 24 glued to the cover 26. However, in some instances the mirror 24 may be separated from the cover 26, thus further increasing the percentage of the total compact that is recyclable. Still further, in some instances the mirror 24 may be made of a plastic material (e.g., a plastic resin) enabling the mirror 24 and the cover 26 to be recycled without requiring separation of the mirror 24 from the cover 26.

Next, application of pressure to the pan securing portion 18 can overcome the restraining force of the circumferential lips 36 and 44 with catches 38 and 40 and enable the pan securing portion 18 to rotate on the hinge 20 relative to the pan receiving portion 14. Once in this position, substantially as shown in FIGS. 1, application of pressure to an exterior surface of the pan receiving portion 16 overcomes any pressure applied to the pan by the circumferential lip 36 and 44 with catches 38 and 40 the pan 16 is forced free from the pan receiving portion 16. Both the aluminum pan 16 and the tri-fold base 12 may now be separately recycled in their respective recycling streams. Additionally or alternatively, the pan 14 may also be returned to the cosmetic company or a third party, for refilling of the cosmetic. Further, the cosmetic company may sell pans 16 with the cosmetic therein for replacement in the tri-fold base 12, allowing the user to replace just the cosmetic and re-using the tri-fold base 12.

In yet a further aspect of the disclosure, rather than having an insertable cover 26 and mirror 24, the tri-fold base 12 may be formed such that the mirror receiving portion 22 is formed in a closed fashion, that is the cover is molded as part of the tri-fold base. In this scenario, the mirror 24 may be glued into the mirror receiving portion 22. The molded in cover becomes to top of the compact 10 once assembled. The remainder of the tri-fold base 12 remains substantially the same and the pan 14 remains removable resulting in a refillable compact 10.

Still a further aspect of the disclosure is directed to a compact 10 employing a snap-fit cover (not shown). In this aspect of the disclosure, the pan receiving portion 14 receives the pan, and a pan securing portion 18 folds over the pan 16 and mates with the pan receiving portion 14 to secure the pan therein. A mirror receiving portion 22 may be separately formed or separated from the tri-fold base 12 (e.g., at hinge 27) and trimmed to remove any sharp edges. The mirror receiving portion 22 may be formed with a solid back (i.e., integrally formed with the cover 26). The mirror 24 may be glued into the mirror receiving portion. Using the snap-fit, the mirror receiving portion 18 can be completely removed from the combination of the pan receiving portion 14 and the pan securing portion 18 which retain the pan 16 and the cosmetics located therein.

Though depicted in the drawings and described herein as being generally round in shape, the compact 10 is not so limited. Other shapes including square, rectangular, triangular, octagonal, etc., are contemplated within the many shapes of the compact without departing from the scope of the disclosure. Further though the pan receiving portion 14 is depicted as receiving a single pan 16, the disclosure is not so limited and multiple pans 16 may be inserted into a pan receiving portion 14. Further the pan receiving portion 14 may be configured with one or more ribs (not shown) which are configured to receive the multiple pans 16. As an example, the pan receiving portion 14 may be square is shape and configured to receive a rectangular pan 16 and two square pans 16, with two ribs formed in the bottom of the pan receiving portion 14 to receive and securely hold the three pans 16.

As a result of the use of a mono-material, such as polypropylene, and the tri-fold construction described herein, the amount of recyclable material is increased, and the volume of waste materials can be further reduced or eliminated.

Still a further aspect of the disclosure is directed to a hot pour or direct pour cosmetic. A hot pour cosmetic is one that is poured directly into the pan receiving portion 14. No pan 16 is needed for hot pour cosmetics. To recycle or reuse a tri-fold base 12 for use with hot pour cosmetics, any residual cosmetic need just be washed out of the pan receiving portion 14. Further, in accordance with the disclosure, the initial use of the tri-fold base 12 may be to receive hot pour cosmetics, and then following an initial use, the user can wash the pan receiving portion 14 and insert a pan 16 having cosmetics therein to allow for reuse of the compact 10.

Although several embodiments and examples are disclosed herein, the present application extends beyond the specifically disclosed embodiments to other alternative embodiments and/or uses of the disclosure and modifications and equivalents thereof. It is also contemplated that various combinations or sub-combinations of the specific features and aspects of the embodiments may be made and still fall within the scope of the disclosure. Accordingly, it should be understood that various features and aspects of the disclosed embodiments can be combined with or substituted for one another in order to form varying modes of the disclosed inventions. Thus, it is intended that the scope of the present disclosure herein disclosed should not be limited by the particular disclosed embodiments described above.

We claim:

1. A tri-fold recyclable compact base comprising:

a pan receiving portion including an inner ring and an outer ring, the inner ring or the outer ring including at least one catch, and the inner ring configured to removably receive a cosmetics pan;

a pan securing portion, the pan securing portion including a top flange and an inner ring extending perpendicularly from the top flange and an outer ring extending perpendicularly from the top flange, the inner ring or the outer ring including at least one circumferential lip configured to mate with the at least one catch;

a first hinge rotatably connecting the pan receiving portion and the pan securing portion;

a mirror receiving portion; and a second hinge rotatably connecting the mirror receiving portion and the pan securing portion.

2. The tri-fold recyclable compact base of claim 1, wherein rotation of the pan securing portion about the first hinge causes the at least one catch to receive the at least one circumferential lip and secure the pan securing portion to the pan receiving portion.

3. The tri-fold recyclable compact base of claim 1, wherein the inner ring and the outer ring of the pan receiving portion each include a catch.

4. The tri-fold recyclable compact base of claim 3, wherein the inner ring and the outer ring each include a circumferential lip configured to mate with the catch of the inner ring and the outer ring of the pan receiving portion.

5. The tri-fold recyclable compact base of claim 4, wherein rotation of the pan securing portion about the first hinge causes the catches on each of the inner ring and the outer ring of the pan receiving portion to receive the circumferential lip on each of the inner ring and outer ring on the pan securing portion to secure the pan securing portion to the pan receiving portion.

6. The tri-fold recyclable compact base of claim 1, further comprising a pan of cosmetics in the pan receiving portion.

7. The tri-fold recyclable compact base of claim 6, wherein the pan securing portion includes a lip extending from the top flange that overlaps the pan, the lip extending over the pan in the pan receiving portion.

8. The tri-fold recyclable compact base of claim 1, further comprising a cover secured in the mirror receiving portion.

9. The tri-fold recyclable compact base of claim 8, wherein tabs on the mirror receiving portion mate with a circumferential ring on the cover to secure the cover in the mirror receiving portion.

10. The tri-fold recyclable compact base of claim 9, further comprising a mirror inserted into the mirror receiving portion.

11. The tri-fold recyclable compact base of claim 10, wherein the mirror is glued to the cover.

12. The tri-fold recyclable compact base of claim 10, wherein the mirror is formed of a plastic and glued to the cover.

13. The tri-fold recyclable compact base of claim 1, formed of polypropylene.

14. The tri-fold recyclable compact base of claim 1, further comprising an opening latch formed on the mirror receiving portion.

15. The tri-fold recyclable compact base of claim 14, wherein the opening latch mates with the first hinge to hold the mirror receiving portion proximate the pan receiving portion.

16. The tri-fold recyclable compact base of claim 1, wherein the mirror receiving portion includes a molded-in cover configured to have a mirror glued thereto.

17. The tri-fold recyclable compact base of claim 1, wherein at least one of the first hinge and the second hinge are living hinges.

18. The tri-fold recyclable compact base of claim 1, wherein the pan receiving portion is configured to receive multiple pans.

19. The tri-fold recyclable compact base of claim 1, wherein the each of the pan receiving portion, the pan securing portion, and the mirror receiving portion have a round shape.

* * * * *